US005238315A

United States Patent [19]

Kitabata

[11] Patent Number: 5,238,315

[45] Date of Patent: Aug. 24, 1993

[54] PRINTER PAPER FEED AND CARRIAGE CONTROL DEVICE

[75] Inventor: Kazuo Kitabata, Suwa, Japan

[73] Assignee: Seiko Epson Corporation, Tokyo, Japan

[21] Appl. No.: 708,102

[22] Filed: May 28, 1991

Related U.S. Application Data

[63] Continuation of Ser. No. 448,449, Dec. 11, 1989, abandoned, which is a continuation-in-part of Ser. No. 439,129, Nov. 17, 1989, Pat. No. 5,128,858.

[30] Foreign Application Priority Data

Nov. 18, 1988 [JP] Japan ..... 63-291493
Dec. 12, 1988 [JP] Japan ..... 63-313331

[51] Int. Cl.[5] ..... B41J 19/70
[52] U.S. Cl. ..... 400/314.1; 400/706
[58] Field of Search ..... 400/624, 625, 629, 706, 400/708, 314, 314.1

[56] References Cited

U.S. PATENT DOCUMENTS 4,257,712 3/1981 McGuire ..... 400/706
4,671,683 6/1987 Ueno ..... 400/708
4,934,845 6/1990 Kato ..... 400/708

FOREIGN PATENT DOCUMENTS 1289 1/1984 Japan ..... 400/706
22765 2/1984 Japan ..... 400/314
54971 3/1986 Japan ..... 400/314.1
89068 5/1986 Japan ..... 400/624
33660 2/1987 Japan ..... 400/314
284775 12/1987 Japan ..... 400/314
21174 1/1988 Japan ..... 400/706

*Primary Examiner*—David A. Wiecking
*Assistant Examiner*—Steven S. Kelley
*Attorney, Agent, or Firm*—Blum Kaplan

[57] ABSTRACT

A control device for a printer for printing on a paper having a print head supported on a movable carriage and a paper feeding device. The printer includes a detector for detecting the presence or absence of paper in the printer wherein a predetermined region remains on the paper when the detector detects the absence of paper. The control device calculates the length of the printable region remaining on the paper and determines whether a sufficient remaining printable region is available at the trailing end of the paper. A paper feeder device feeds the paper in a predetermined amount. A carriage control device controls driving of the carriage. Driving of the carriage starts at a time before the paper feeding has ceased such that the speed of the carriage reaches a printing level when paper feeding has ended.

7 Claims, 4 Drawing Sheets

PRINTER PAPER FEED AND CARRIAGE CONTROL DEVICE

CROSS-REFERENCE TO RELATED APPLICATION

This is a continuation of now abandoned application Ser. No. 07/448,449, filed on Dec. 11, 1989 which is a continuation-in-part application of U.S. patent application Ser. No. 07/439,129 filed on Nov. 17, 1989 which is now U.S. Pat. No. 5,128,858 entitled PAPER FEED CONTROL DEVICE FOR A PRINTER AND METHOD FOR CONTROLLING SAME.

BACKGROUND OF THE INVENTION

The present invention relates generally to a device for controlling print head movement and paper feeding in a printer, and, in particular, to a method and device for controlling actuation of a print head carriage motor and paper feed motor in a printer which operate in response to control commands from a host computer.

Devices for controlling the carriage motor and paper feed motor in a printer are known in the art. Such conventional devices operate such that control sequences of the carriage motor ("CR" motor) and the paper feed motor ("PF" motor) in a driving pattern are as shown in FIG. 1 of the drawings. Referring to FIG. 1, it is seen that the carriage motor accelerates during a period a to reach full carriage speed during period b and then decelerates during period c at which time the PF motor begins to accelerate during period e to a constant speed during period f. After period g when the PF motor decelerates to a rest position, CR motor once again begins to accelerate during period a and the cycle repeats until printing is completed.

Accordingly, after the paper feed action has completely terminated, the device judges whether or not the printer is in condition to print. Upon determining that the printer is in condition to print, the driving of the CR motor is started and printing begins in such conventional devices.

Such systems are slow and decrease the real print speed time of the printer because it is dependent on the drive time of the CR motor and its relation to the driving of the PF motor. In such conventional systems, the carriage does not start movement until paper feeding has ended. This reduces the actual printing speed of the printer.

Accordingly, it is desired to provide a carriage and paper feed control device and a method for a printer which eliminates the down time wasted as caused by the inadequate interaction between the two devices, thereby improving the actual printing speed of the printer.

SUMMARY OF THE INVENTION

Generally speaking, in accordance with the present invention, a control device for a printer for printing on a paper having a print head supported on a carriage and a carriage motor for moving the carriage to permit printing along lines on the paper is provided. The printer includes a paper feeding device for feeding the paper past the carriage. The printer also includes a paper detector for detecting when the trailing end of the paper passes the detector. The paper is defined as having a predetermined printable region at the trailing end thereof determined at the time when the detector switches from an indication of paper presence to an indication of paper absence. The control device includes a calculating device for calculating the length of the printable region remaining on the paper when the detector indicates that the trailing end of the paper has passed the detector based on the predetermined printable region and the amount of paper feeding after the trailing end has passed the detector. An estimating device determines whether a sufficient remaining printable region is available at the trailing end of the paper after the trailing end of the paper has passed the detector based upon the remaining length determined by the calculating device and the paper feed amount to be performed before printing. A paper feeding control device controls the feeding of the paper when the estimating device determines a sufficient remaining printable region at the trailing end of the paper. A carriage control device drives the carriage on which the print head is supported to permit the print head to print on a paper subsequent to paper feeding. The carriage control device starts the driving of the carriage motor at a time before the paper feeding has ceased such that the speed of the carriage motor reaches a printing speed at the time when paper feeding has ended.

Accordingly, it is an object of the present invention to provide an improved carriage and paper feed control device for a printer.

Another object of the present invention is to provide a control device for a printer in which the time wasted between the termination of paper feed and acceleration of the carriage is substantially reduced.

Yet another object of the present invention is to provide a printer control in which the deceleration of the paper feed motor is overlapped with the acceleration of the carriage motor.

Still another object of the present invention is to improve the quality of printing in a printer.

Yet a further object of the present invention is to provide user friendly features for paper handling during the feeding of paper.

Still other objects and advantages of the invention will in part be obvious and will in part be apparent from the specification.

The invention accordingly comprises the several steps and the relation of one or more such steps with respect to each of the others in the apparatus embodying features of construction, combination of elements and arrangements or parts which are adapted to effect such steps, all as exemplified in the following detailed disclosure, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 2:
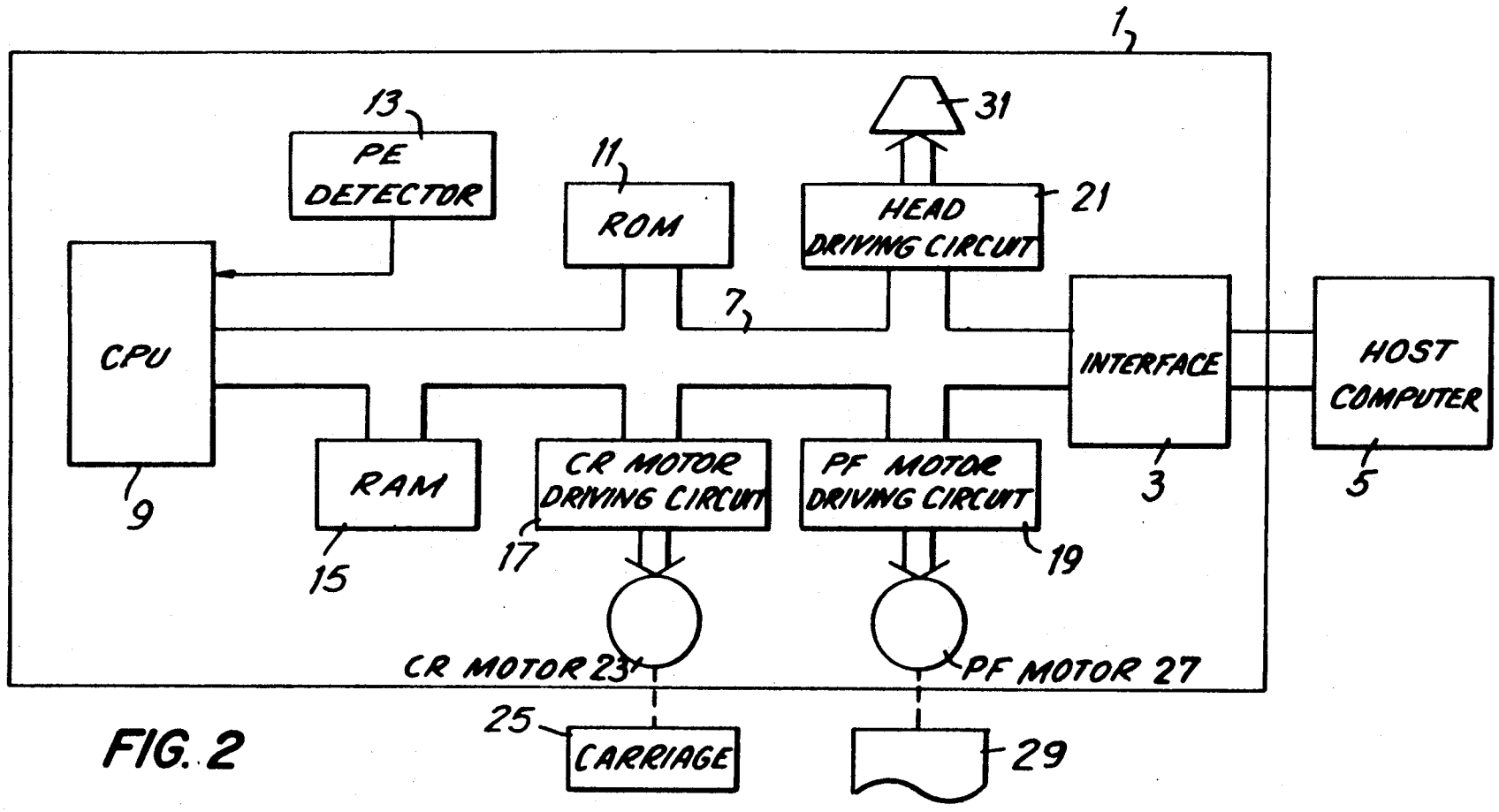
FIG. 2 is a block diagram of a printer control device constructed in accordance with the present invention.

A printer control device, generally indicated at 1, constructed in accordance with the invention, is shown in FIG. 2. Printer control device 1 is connected to an external host computer 5 by interface 3. Printer control device 1 includes CPU 9 coupled to interface 3 by an address and data bus 7. Bus 7 also couples CPU 9 to a ROM 11 and a RAM 15. A paper presence ("PE") detector 13 outputs a PE signal indicating the presence or absence of paper in the printer.

CPU 9 controls printing in accordance with the control program stored in ROM 11. Print data and print control commands for controlling paper feed, carriage movement and other functions are output by host computer 5. This data is stored in interface 3 or RAM 15. During printer control, CPU 9 first reads and interprets the data found in interface element 3 and, if necessary, refers to the signal from PE detector 13 as well as various data for printing control which were previously stored in ROM 11 or RAM 15. Then, CPU 9 performs computations in accordance with the control program based on the data and delivers a command to a CR motor driving circuit 17, a PF motor driving circuit 19 and a head driving circuit 21 through bus 7 for controlling each of these circuits based upon the computation.

CR motor driving circuit 17 drives a CR motor 23 in accordance with commands from CPU 9 to move carriage 25 along guides 39 (FIG. 3). PF motor driving circuit 19 drives a PF motor 27 for feeding paper 29. CR motor 23 and PF motor 27 are step motors allowing the amount of carriage movement and the amount of paper feed to be determined by the number of steps of each motor. Head driving circuit 21 drives a print head 31 mounted on carriage 25 to conduct printing. Printing is conducted during the movement of carriage 25 and paper 29 is fed when carriage 25 stops.

Figure 3A:
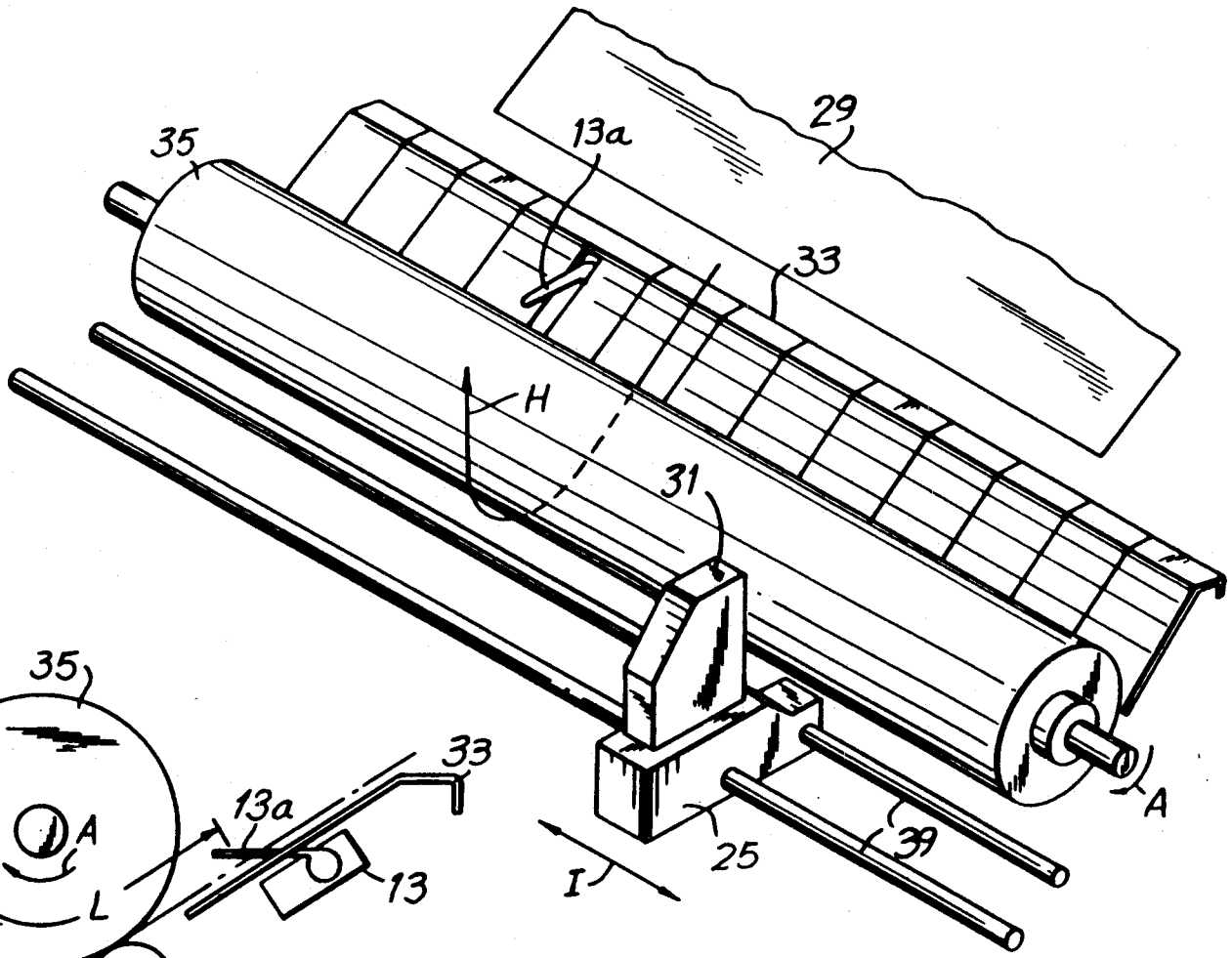
FIG. 3A is a perspective view of the platen portion of a printer constructed in accordance with the present invention.
Figure 3B:
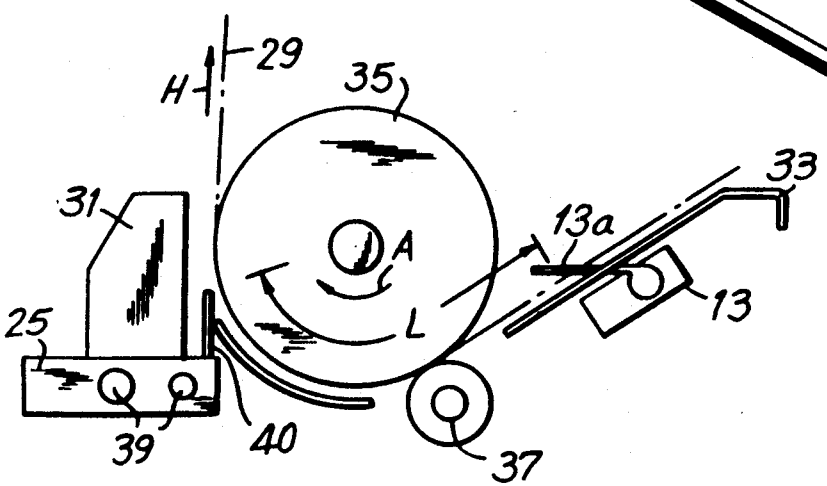
FIG. 3B is a side elevational view of the printer depicted in FIG. 3A.

As seen in FIGS. 3A and 3B, a platen 35 is rotatably mounted within the printer. Carriage 25 is mounted on guide rods 39 adjacent to platen 35 and performs reciprocal movement in the direction of arrows I along platen 35. Print head 31 is mounted on carriage 25 in facing relationship with platen 35. A paper guide 33 is disposed on the opposed side of platen 35 spaced from platen 35. A detection pin 13*a* for detecting the presence or absence of paper extends through paper feeding guide 33 and is coupled to PE detector 13. A paper feeding roller 37 abuts platen 35 and cooperates with platen 35 to feed paper 29 through the printer.

Paper 29 is inserted in the direction of arrow H between platen 35 and paper feeding guide 33 in the direction of paper roller 37. Paper roller 37 drops the paper 29 between the paper roller 37 and platen 35 to feed paper 29 towards print head 31. Platen 35 is rotated in the direction of arrow A by PF motor 27. A line pitch previously stored in RAM 15 as the number of steps PF motor 27 must advance each line is utilized during paper feeding. The actual paper feed amount is specified by a paper feed control command output by host computer 5.

In an exemplary embodiment, PE detector 13 is a microswitch. PE detector 13 is positioned on the back side of paper feeding guide 33 so that detection pin 13*a* projects through paper feeding guide 33 within the paper feed path. When paper 29 is present, detection pin 13*a* is depressed causing PE detector 13 to output a signal corresponding to paper 29 being present. When paper 29 is fed through the printer, and the trailing end of paper 29 passes detection pin 13*a*, the output of PE detector 13 changes from a paper presence signal to a paper absent ("PE") signal.

Carriage 25 is mounted on guide rods 39 adjacent to platen 35 and performs reciprocal movement in the direction of arrows I along platen 35. Print head 21 mounted to carriage 25 is driven to perform printing. When the printing of a given line is completed, movement of carriage 25 decelerates and stops. At the same time, paper 29 is fed by PF motor 27 as described above. PF motor 27 begins to accelerate when CR motor 23 begins deceleration to a new line for printing. Prior to the deceleration period of PF motor 27, carriage 25 is re-shifted to perform printing of the new line, thereby creating an overlap between the movement of the CR motor 23 and the PF motor 27.

When the PE signal is produced indicating the trailing edge of the paper has passed detection pin 13*a*, there still remains a printable region of paper on paper 29 which may be utilized for printing. This region is defined by distance L corresponding to the distance along paper 29 extending from detection pin 13*a* to a presser plate 40 positioned just before print head 31. The distance L is an override amount and has a fixed value dependent upon the relative positioning of PE detector 13 and presser plate 40. This override amount L may be converted into a number of steps of PF motor 27 and stored either in ROM 11 or RAM 15.

The number of lines which may be printed within the override distance L differs in accordance with the line pitch and with the bottom margin remaining at the trailing edge of paper 29. The data for setting a line pitch and margin width together with the data on the number of line characters, intercharacter pitch, character magnification and the like comprise the format data for printing. This format data is input to print control 1 from host computer 5 prior to the inputting of the data for executing a printing operation even including printing data and printing control commands. The format data is transmitted from interface 3 to CPU 9 and then written into a dedicated area of RAM 15.

Figure 1:
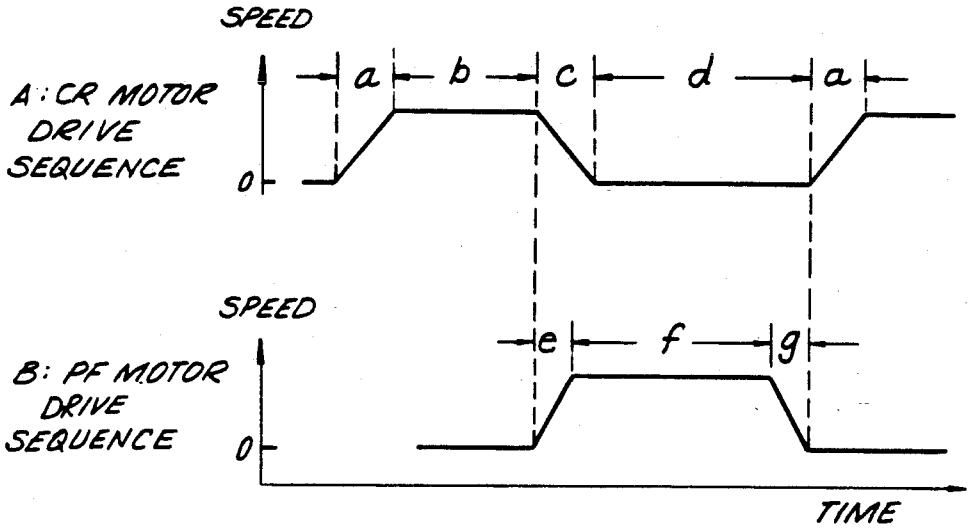
FIG. 1 PRIOR ART
FIG. 1 is a graph of the driving sequence of a PF motor and a CR motor in accordance with the prior art.
Figure 4:
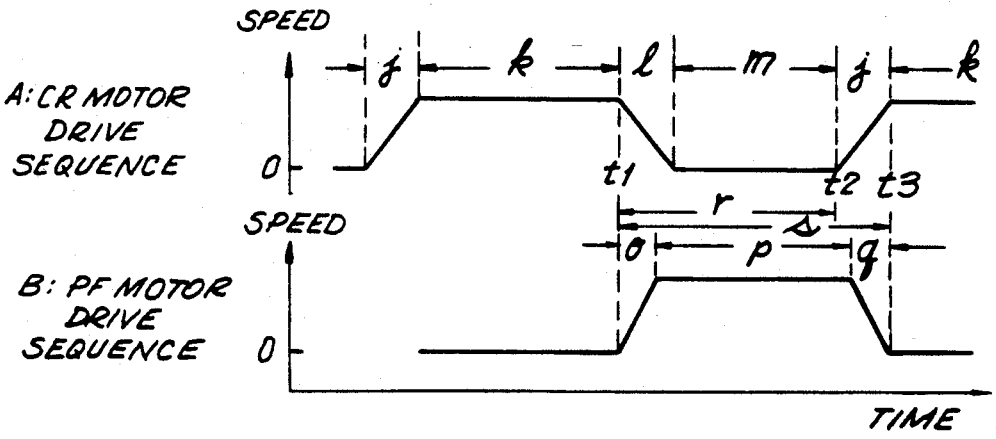
FIG. 4 is a graph of the driving sequence of the CR motor and PF motor in accordance with the present invention.
Figure 5:
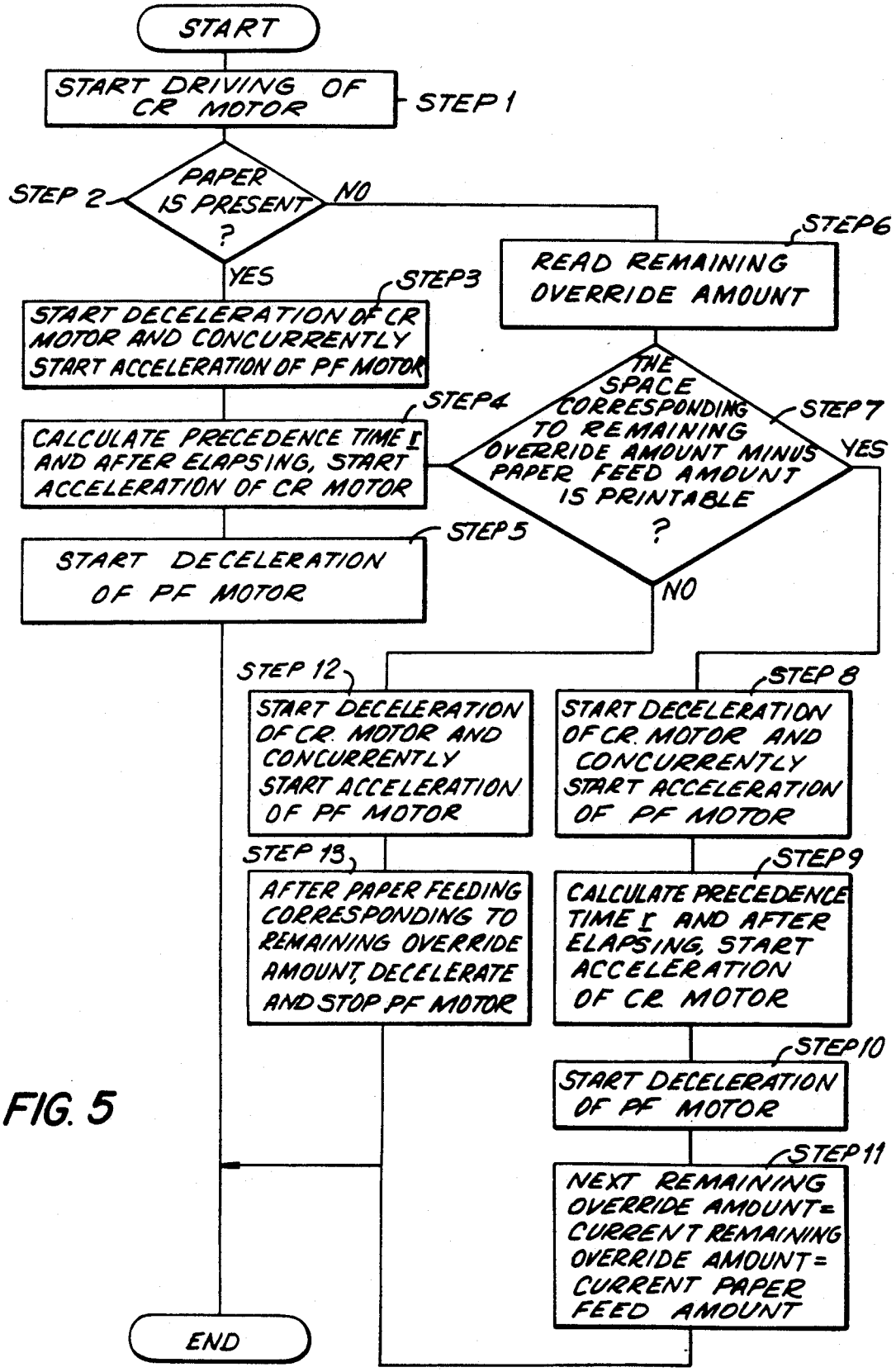
FIG. 5 is a flow chart of the processing of a CPU in accordance with the control device of the present invention.

Reference is now made to FIGS. 4 and 5 where the operation between two successive shift actions of carriage 25 of print control device 1 is detailed. Section A of FIG. 4 depicts the drive sequence of CR motor 23 in a time versus speed graph in which: j is the acceleration zone of CR motor 23, k is a constant speed zone where printing occurs, 1 is a deceleration zone, and m is a stop zone. Section B of FIG. 4 depicts the drive sequence of PF motor 27 in a time versus speed graph in which: o is an acceleration zone, p is a constant speed zone, and q is a deceleration zone.

The control of CR motor 23 and PF motor 27 is such that they operate in a fashion dependent upon one another. PF motor 27 begins to accelerate at a time t1 when deceleration of CR motor 23 begins. CR motor 23 decelerates over deceleration period 1 and zone 1. PF motor at this time accelerates over a time zone o as shown in FIG. 4. When CR motor 23 decelerates to stop, it remains stopped in period m for a predetermined duration. At the same time, when PF motor 27 reaches its predetermined drive speed, it operates at constant speed during period p. Next, CR motor 23 accelerates a second time at a time t2 prior to the stopping of PF motor 27. CR motor 23 reaches a predetermined constant speed at period k at a time t3 when PF motor 27 stops. The overlapping drive period between CR motor 23 and the PF motor 27 prevents the waste of time between termination of paper feeding and the next shifting of the carriage. This enables the printer to feed paper and print at a faster rate.

CPU 9 performs an arithmetic process to realize the drive sequence of FIG. 4. CPU 9 receives print control commands to calculate the time r measured from the acceleration beginning moment t1 of PF motor 27 to the acceleration beginning moment t2 of CR motor 23. CPU 9 makes a determination as to whether or not paper 29 has contact with platen 35 in time r to result in a non-printable state. The control commands are first stored in the interface 3 and then read out by CPU 9. CPU 9 executes an arithmetic process which will be described in connection with the flow chart of FIG. 5 to demonstrate the interaction of CR motor 23 and paper feed motor 27.

CPU 9 sends commands to CR motor driving circuit 17 which drives CR motor 23 in step 1. When the output value of PE detector 13 indicates that paper is present in a step 2, the drive sequence between CR motor 23 and PF motor 27 is performed. At that moment, CR motor 23 is accelerated over a time zone j until it attains the constant speed state k predetermined by CPU 9. The shift amount of the CR motor is determined by a step count of CR motor 23. CR motor 23 begins to decelerate at a moment t1. At the time of deceleration of CR motor 23, PF motor 27 accelerates at a step 3. PF motor 27 attains its predetermined maximum speed and remains at a constant speed over period p while CR motor 23 is at rest in period m.

During the paper feeding interval of step 3, CPU 9 calculates the time r referred to as the precedence time. Time r is calculated from the moment t1 of PF motor 27 to the acceleration beginning moment t2 of CR motor 23 in step 4. Precedence time r is calculated by subtracting acceleration time j of CR motor 23 from the required paper feed time s. Paper feed time s is calculated from the moment t1 to the moment t3. Feed time s varies by the paper feed commands of the instructed paper feed amount, the characteristic data, acceleration constant speed and deceleration of PF motor 27. Times s and j are paper feed amounts instructed by the print control commands through host computer 5 and converted by CPU 9 into the form of a step count of PF motor 27 on the basis of the data stored in RAM 15. When precedence time r terminates, moment t2 begins. At moment t2, CR motor 23 starts to accelerate in step 4, and PF motor 27 begins deceleration at predetermined time t2 thereafter in step 5. At moment t3 in step 5, CR motor 23 attains its constant speed drive state k, while the PF motor 27 stops.

When the output value of the PE detector 13 at step 2 indicates that paper is absent, CPU 9 sends out a different set of commands. The override amount stored in RAM 15 is read in a step 6. The distance L is an override amount and has a fixed value dependent upon the relative positioning of the PE detector 13 and presser plate 40. Override amount L is converted into a number of steps for PF motor 27 which is prestored either in ROM 11 or RAM 15. The first override amount is read and stored which is the distance between detector 13 and presser plate 40. However, the override amount L is updated with each drive sequence in a step 11 hereinafter described at the moment of the second PF paper feeding.

CPU 9 makes a determination as to whether or not the space corresponding to the override amount is printable in a step 7. CPU 9 makes a calculation by subtracting the paper feed amount from the remaining override amount L. CPU 9 then subtracts marginal width from the previous calculation. If this space is greater than the size of the characters to be printed based on the character magnifying factor stored in RAM 11, then such characters are deemed to be printable.

If the override amount L from step 7 is judged by CPU 9 to be printable, then the next three steps 8, 9 and 10 work in the identical fashion as step 3, 4 and 5 as described previously. The current paper feed amount is then subtracted from the current remaining override amount L to determine the next remaining override amount L in a step 11. The newly determined override amount L is then stored in RAM 15 to be used when the process is next executed.

When CPU 9 determines at step 7 that the remaining paper is non-printable, the operation sequence executes the following shift actions. At a step 12, the status of the printer stands at a moment t1 when CR motor 23 begins its deceleration concurrent with the acceleration of PF motor 27. PF motor 27 will feed the paper to the extent of the override amount as stored in RAM 11. Next, the PF motor 27 feeds the paper over a time period p and begins its deceleration over a time zone q and terminates at a step 13. This step represents the end of the drive sequence whereby the paper 29 is released from platen 35. An alternative method to step 13 will shut down PF motor 27 at the moment CR motor begins its deceleration after it is determined that a non-printable amount of paper exists. Then, when the next sheet of paper 29 is fed, there will be a shifting of the carriage in accordance with the amount stored in RAM 11.

Step 4 and step 9 correspond to step 1 of CR motor 23 whereby the drive sequences are identical. Therefore, as CR motor 3 and PF motor 27 go through their sequence at the appropriate time, the acceleration of the CR motor has an equivalent function. As the sequences continue, the drive circuit returns to step 1 or step 2 of the command device. The process therefore continues until the sequence shifts to step 12 of the control device. At that point, there will be no more printable information to be printed and the system will terminate.

In the embodiment described above, modifications may be made to expand the scope of the invention. For example, a no paper flag may be set when the absence of paper 29 is detected. The flag would be set at each sequence in which CR motor 23 and PF motor 27 execute two successive shifts whereby step 6 through step 11 of FIG. 6 are repeatedly performed.

In addition, the length of the bottom margin or any of the other parameters may be subtracted from the override amount L so as to determine the corresponding printable region. A judgment of printability may be made by comparing the remaining override amount L with the paper feed amount. If the override amount L is larger, then the remaining paper is printable. In addition, a judgment of printability may be made on the basis of the override amount L or the remaining override amount.

It will thus be seen that the objects set forth above, among those made apparent from the preceding description are efficiently attained and, since certain changes may be made in carrying out the above method and in the construction set forth, without departing from the spirit and scope of the invention, it is intended that all matter contained in the above description and shown in the accompanying drawings shall be interpreted as illustrative and not in a limiting sense.

It is also to be understood that the following claims are intended to cover all the generic and specific features of the invention herein described and all statements of the scope of the invention which, as a matter of language, might be said to fall therebetween.

What is claimed is:

1. A control device for a printer for printing on a paper having a print head support on a carriage and a carriage motor for moving said carriage to permit printing along lines of said paper, said printer further including paper feeding means for feeding said paper past said carriage, said printer having a paper presence detecting means for indicating when a trailing end of the paper within the printer passes said detecting means, paper feeding control means for controlling the feeding of said paper by said paper feeding means before the next printing, carriage control means for dividing said carriage motor to permit said print head to print on said paper after said paper feeding is performed, the paper having a predetermined printable region at the trailing end thereof, comprising:

calculating means for calculating the length of the printable region remaining on the paper when said detecting means indicates that the trailing end of said paper has passed said detecting means based on the predetermined printable region and the amount of paper feeding after said trailing end has passed said detecting means; and estimating means for determining whether a sufficient remaining printable region is available at the trailing end of said paper after the trailing end of said paper has passed said detecting means based upon the remaining length determined by the calculating means and the paper feed amount to be performed before the next printing;

wherein when said detecting means determines said paper is present, said carriage control means starts the driving of said carriage motor at a time before said paper feeding has ceased such that the speed of said carriage motor reaches a printing speed by the time that said paper feeding has ended;

wherein when said detecting means switches from an indication of paper presence to an indication of paper absence and when said estimating means determines a sufficient remaining printable region at said trailing end of said paper, said carriage control means starts the driving of said carriage motor at a time before said paper feeding has ceased such that the speed of said carriage motor reaches a printing speed by the time that said paper feeding has ended;

wherein when said detecting means switches from an indication of paper presence to an indication of paper absence and when said estimating means determines said trailing end of said paper is not printable, said carriage control means decelerates concurrently with the acceleration of said paper feeding control means so that when said paper feeding is complete, said paper feeding control means stops.

2. The control device as claimed in claim 1, wherein said paper feeding control means performs paper feeding when the output of the detecting means indicates paper to be present.

3. The control device as claimed in claim 1, wherein the acceleration of the paper feeding means to feed paper before the next printing starts concurrently with the deceleration of the carriage motor when the previous printing has ended.

4. The control device as claimed in claim 1, wherein said carriage control means predicts the time from the beginning of paper feeding before the next printing to the beginning of driving of the carriage motor on the basis of the paper feed amount before the next printing and data from the paper feeding control means motor and carriage control means, and starts driving of the carriage motor when the elapsed time from the beginning of paper feeding reaches the predicted time.

5. The control device as claimed in claim 1, wherein when the carriage control means begins to accelerate the carriage motor, the paper feeding control means begins to decelerate the paper feeding means.

6. The control device as claimed in claim 1, wherein the carriage control means causes said carriage to reach a constant speed at the time when the paper feeding control means stops the paper feeding means.

7. A method for controlling a printer for printing on a paper having a print head supported on a carriage and a carriage motor for moving said carriage to permit printing along lines on said paper, said printer further including paper feeding means for feeding said paper past said carriage, said printer having a paper presence detecting means for indicating when a trailing end of the paper within the printer passes said detecting means, the paper having a predetermined printable region at the trailing end thereof determined at the time when the detecting means switches from an indication of paper presence to an indication of paper absence, comprising the steps of calculating the length of the printable region remaining on the paper when the detecting means indicates paper absence based on the predetermined printable region and the amount of paper feeding after said trailing end of said paper has passed said detecting means, determining whether a sufficient remaining printable region is available at the trailing end of the paper after the trailing end of the paper has passed the detecting means based upon the remaining length determined by the calculating means and the paper feed amount to be performed before the next printing, controlling driving of the paper feeding means to perform paper feeding before the next printing when the determined result is indicative of a sufficient remaining printable region, and starting driving of the carriage motor to perform the next printing after execution of paper feeding in advance of the termination of paper feeding such that the speed of the carriage motor reaches a drive speed suitable for printing when the paper feeding has terminated.

* * * * *